US006431375B2

(12) United States Patent
Spencer

(10) Patent No.: US 6,431,375 B2
(45) Date of Patent: Aug. 13, 2002

(54) METHOD FOR DISPLAYING LICENSE PLATE FRAMES

(76) Inventor: Paul E. Spencer, 19475 Beacon Lite Rd., Monument, CO (US) 80132

( * ) Notice: Subject to any disclaimer, the term of this patent is extended or adjusted under 35 U.S.C. 154(b) by 0 days.

(21) Appl. No.: 09/781,490

(22) Filed: Feb. 13, 2001

Related U.S. Application Data

(63) Continuation-in-part of application No. 29/126,639, filed on Jul. 21, 2000.

(51) Int. Cl.[7] ..... A47F 7/00

(52) U.S. Cl. ..... 211/106; 211/49.1; 211/55; 211/184

(58) Field of Search ..... 211/55, 50, 49.1, 211/181.1, 106, 184, 90.03, 90.02

(56) References Cited

U.S. PATENT DOCUMENTS

D162,397 S * 3/1951 Fink
3,595,404 A * 7/1971 Goldstein ..... 211/106 X
3,929,248 A * 12/1975 Morrison ..... 211/184 X
4,331,243 A * 5/1982 Doll ..... 211/184 X
4,516,682 A * 5/1985 Bell ..... 211/106 X
4,694,966 A * 9/1987 Sorenson et al. ..... 211/181.1 X
4,813,535 A * 3/1989 Radocha et al. ..... 211/106 X
5,082,125 A * 1/1992 Ninni ..... 211/184
5,449,076 A * 9/1995 Van Noord ..... 211/181.1
D382,133 S * 8/1997 Messina et al.
D382,140 S * 8/1997 Loflin
6,161,708 A * 12/2000 Myler ..... 211/106 X
6,164,462 A * 12/2000 Mumford ..... 211/90.03 X

* cited by examiner

*Primary Examiner*—Robert W. Gibson, Jr.
(74) *Attorney, Agent, or Firm*—Timothy Thut Tyson; Ted Masters; Freilich, Hornbaker & Rosen

(57) ABSTRACT

A display rack (20) for license plate frames (500) includes a plurality of license plate frame receiving stations (24) which are arranged in side-by-side relationship. The stations (24) are separated by movable dividers (26) which may be laterally moved to change the relative width of adjacent stations (24). Display rack (20) also includes pegboard connectors (34) which are selectively movable along a frame member (21) to effect alignment with holes (504) in a pegboard (502) so that display rack (20) can be mounted on a sheet of pegboard (502).

2 Claims, 9 Drawing Sheets

20
21
22
23
24
25
26
28
34
500
W 35
502
504
34
21

32
21
30
26
32
23
30

METHOD FOR DISPLAYING LICENSE PLATE FRAMES

CROSS REFERENCE TO RELATED APPLICATION

This application is a Continuation In Part of Design Patent application 29/126,639, filed Jul. 21, 2000, which is included herein by reference.

TECHNICAL FIELD

The present invention pertains generally to display racks for products, and particularly to a display rack for license plate frames.

BACKGROUND ART

Display racks for a multitude of different products are well known in the art. These devices range from magazine racks to toy racks, and from food racks to clothes racks. In the automotive business, customized license plate frames are becoming very popular. A variety of frame styles, designs, and sizes are currently available. In order to effectively present these products to consumers, a versatile display rack is a necessity.

DISCLOSURE OF INVENTION

The present invention is directed to a display rack for license plate frames. The display rack has a plurality of license plate frame receiving stations which are disposed in side-by-side relationship. A sliding movable divider separates adjacent stations. The movable divider may be moved laterally in either direction, thereby changing the width of the stations. This feature allows license plate frames of varying widths, typically between six inches and six and three quarter inches, to be placed in the display rack. For example, by selectively moving the movable divider toward an adjacent station, the width of the adjacent station is diminished while the width of the present station is increased. The present invention also incorporates movable pegboard connectors which can be laterally moved to align with the holes in a sheet of pegboard. This permits the display rack to be conveniently installed upon the pegboard.

In accordance with a preferred embodiment of the invention, a display rack for license plate frames includes a frame having a plurality of license plate frame receiving stations, the stations arranged in side-by-side relationship. The stations are shaped and dimensioned to receive a license plate frame. The stations are separated by a slidably movable divider, so that when the movable divider is selectively moved from a first position to a second position, the width of the one station is dimensionally reduced, while the width of a second adjacent station is correspondingly dimensionally increased.

In accordance with an important aspect of the invention a bottom plurality of stations are stackably disposed beneath a top plurality of stations.

In accordance with another preferred embodiment of the invention, at least two pegboard connectors are slidably connected to the frame. The pegboard connectors can be selectively moved to align with holes in a pegboard, so that the display rack can be mounted on the pegboard.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
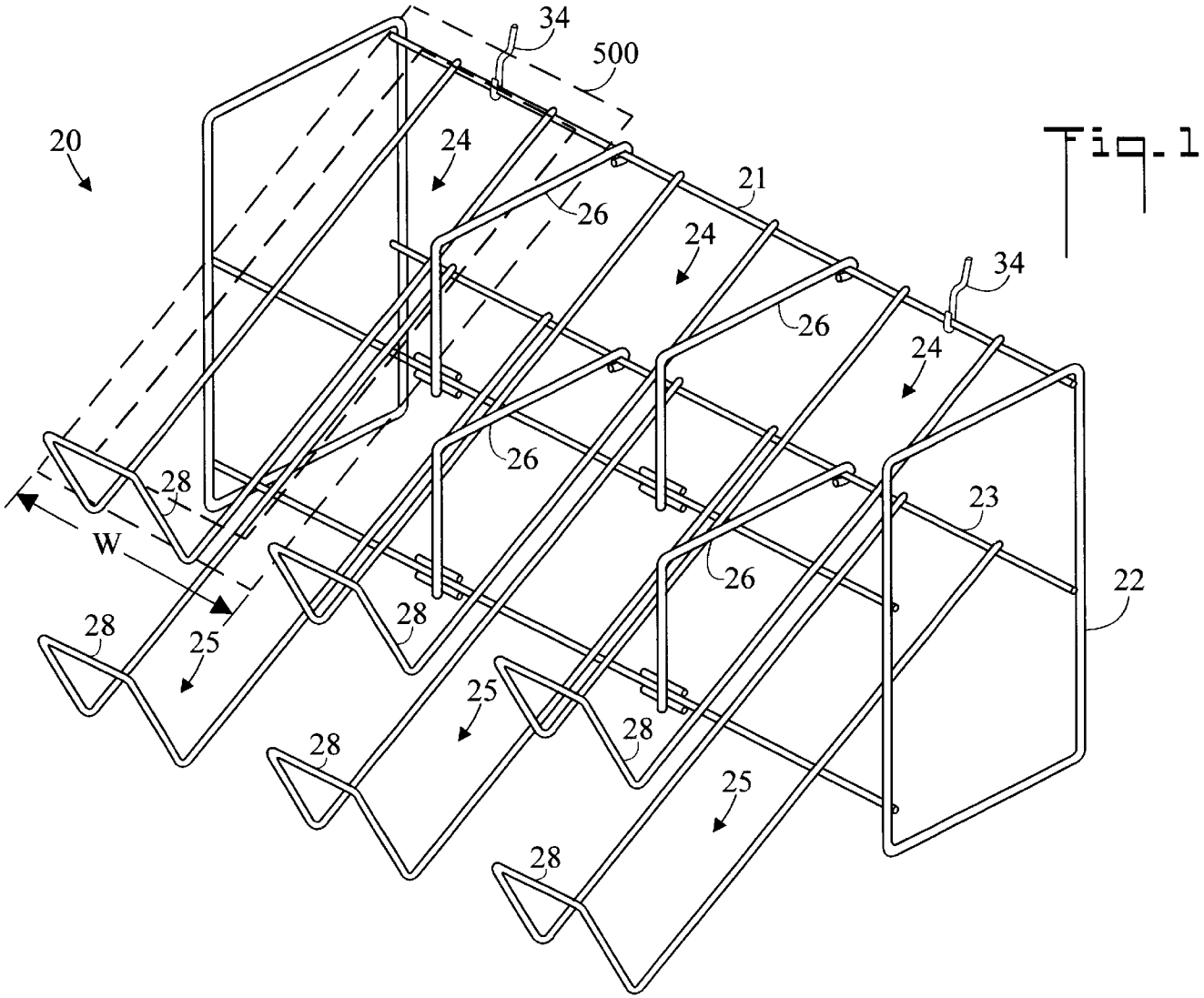
FIG. 1 is a perspective view of a display rack for license plate frames in accordance with the present invention.
Figure 2:
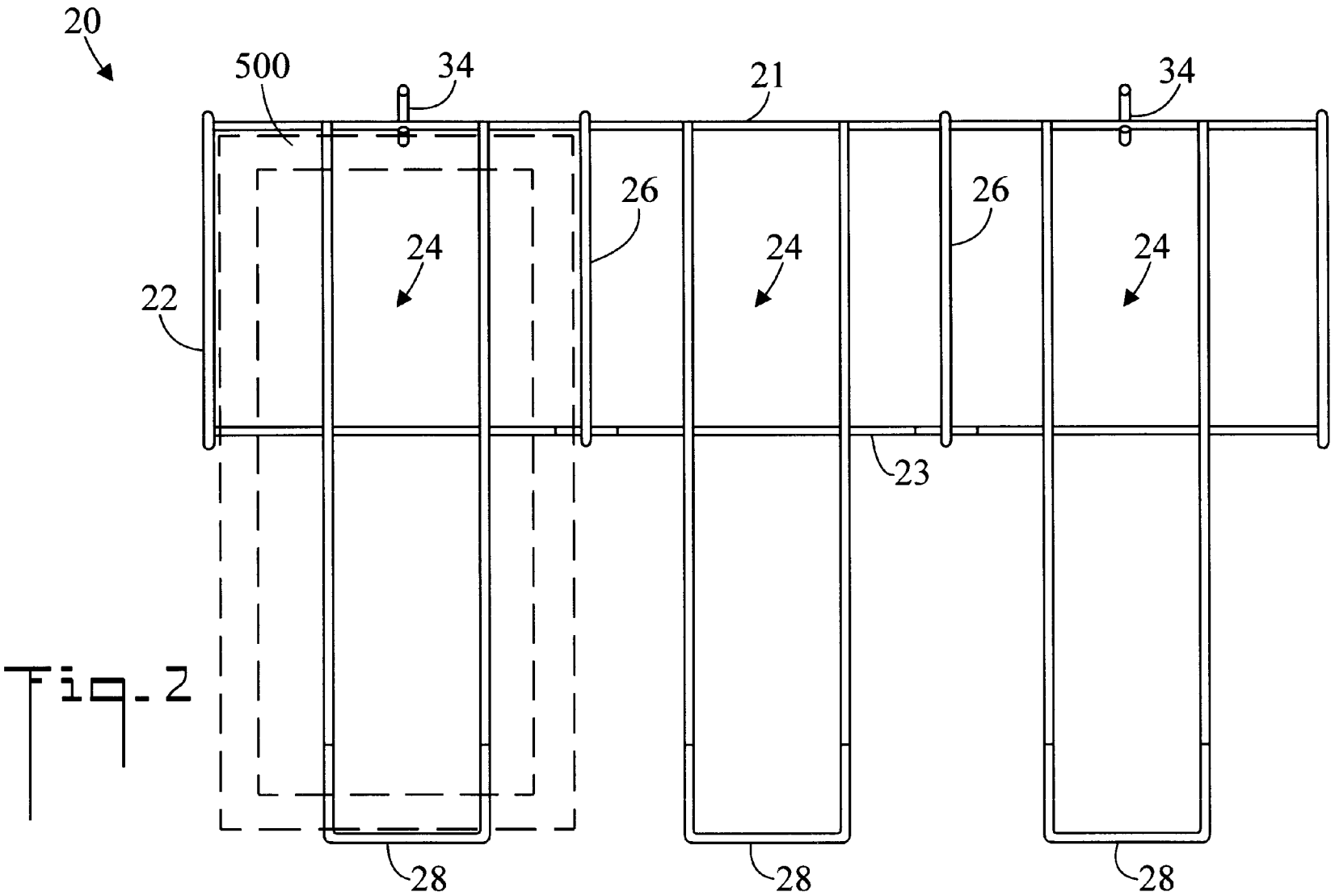
FIG. 2 is a top plan view of the display rack.
Figure 3:
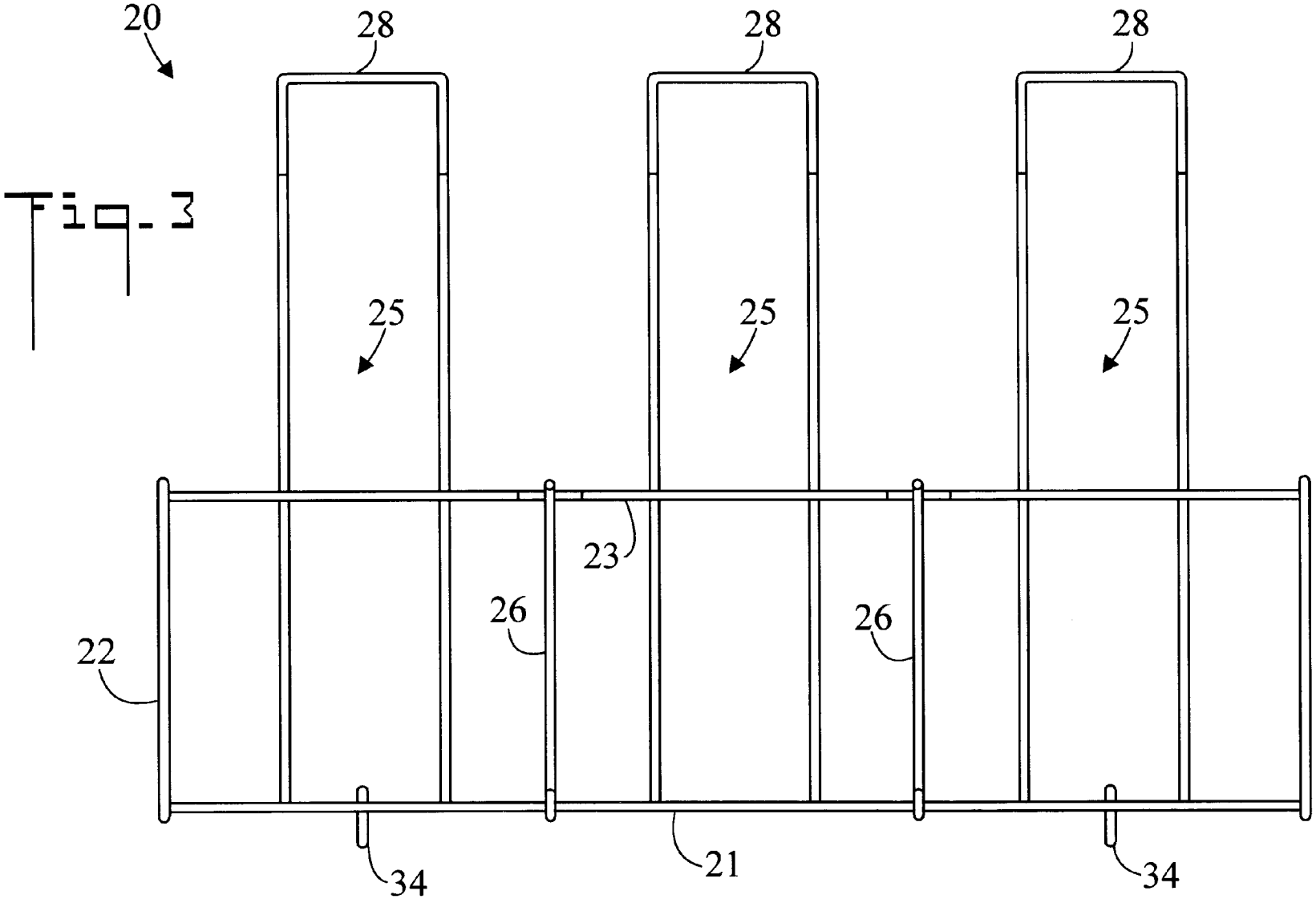
FIG. 3 is a bottom plan view of the display rack.

FIGS. 1–5 are perspective, top plan, bottom plan, front elevation, and side elevation views, respectively, of a display rack for license plate frames in accordance with the present invention, generally designated as 20. Display rack 20 includes a frame 22 which, in a preferred embodiment, is fabricated from metal rod segments which are bent and welded into a desired shape. Display rack 20 includes a plurality of license plate frame receiving stations 24 which are arranged in side-by-side relationship, wherein each station 24 is separated from an adjacent station 24 by a slidably movable divider 26. License plate receiving stations 24 are shaped and dimensioned to receive a license plate frame 500 having a width W. Width W typically varies between six inches and six and three quarter inches. It may be appreciated that a plurality of license plate frames 500 may be vertically stacked within each license plate frame receiving station 24 (refer to FIG. 5). In a preferred embodiment, a second plurality of license plate receiving stations 25 are stackably disposed beneath the plurality of stations 24. In the shown embodiment, display rack 20 includes three top stations 24 and three bottom stations 25. Stations 24 and 25 each include a foot portion 28 for retaining the license plate frames 500 within the stations. The shown embodiment includes three side-by-side stations 24 stacked on top of three other stations 25. However, it may be appreciated that the present invention could include any practical number of side-by-side stations 24 or number of vertical layers.

Figure 4:
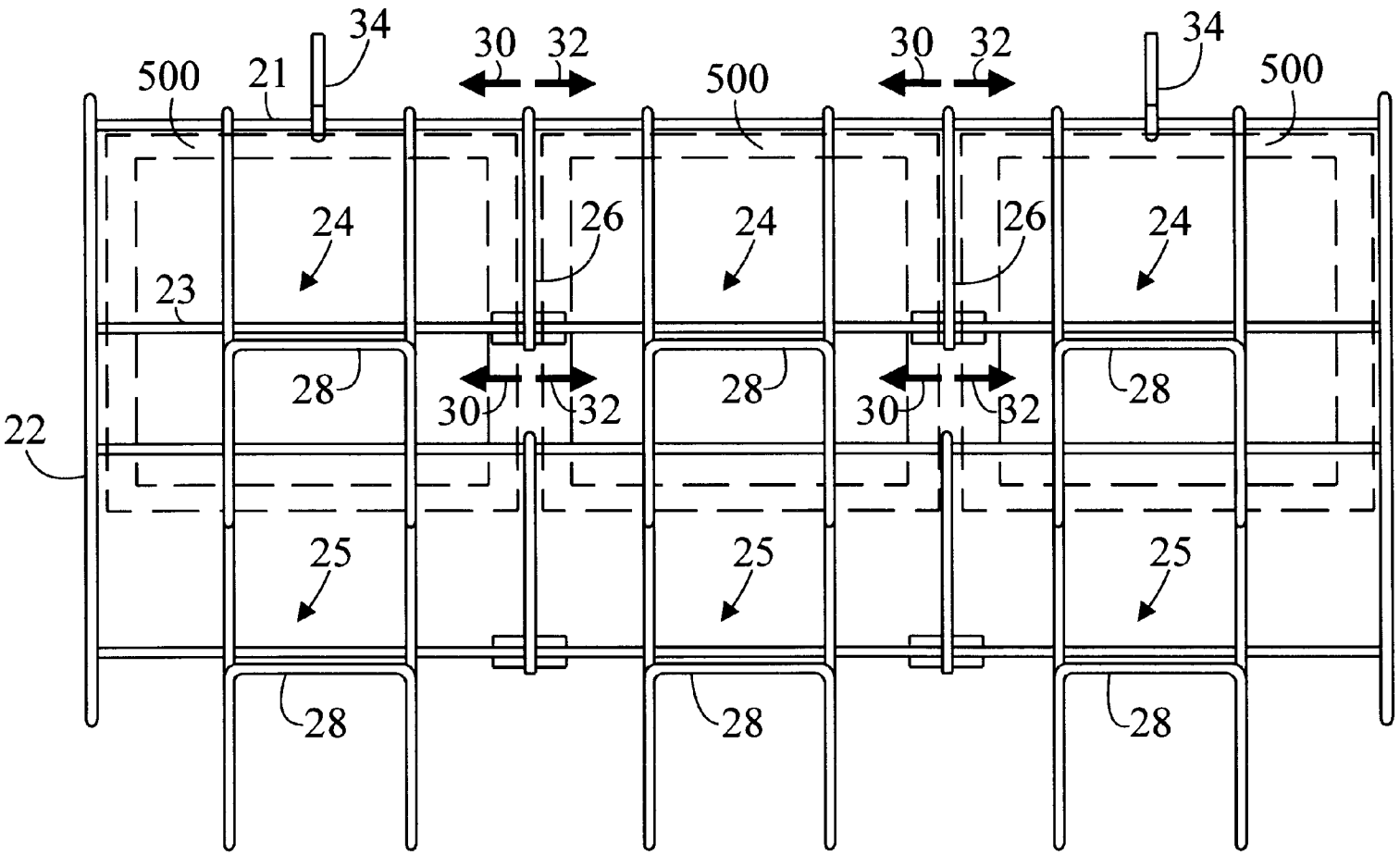
FIG. 4 is a front side elevation view of the display rack.
Figure 5:
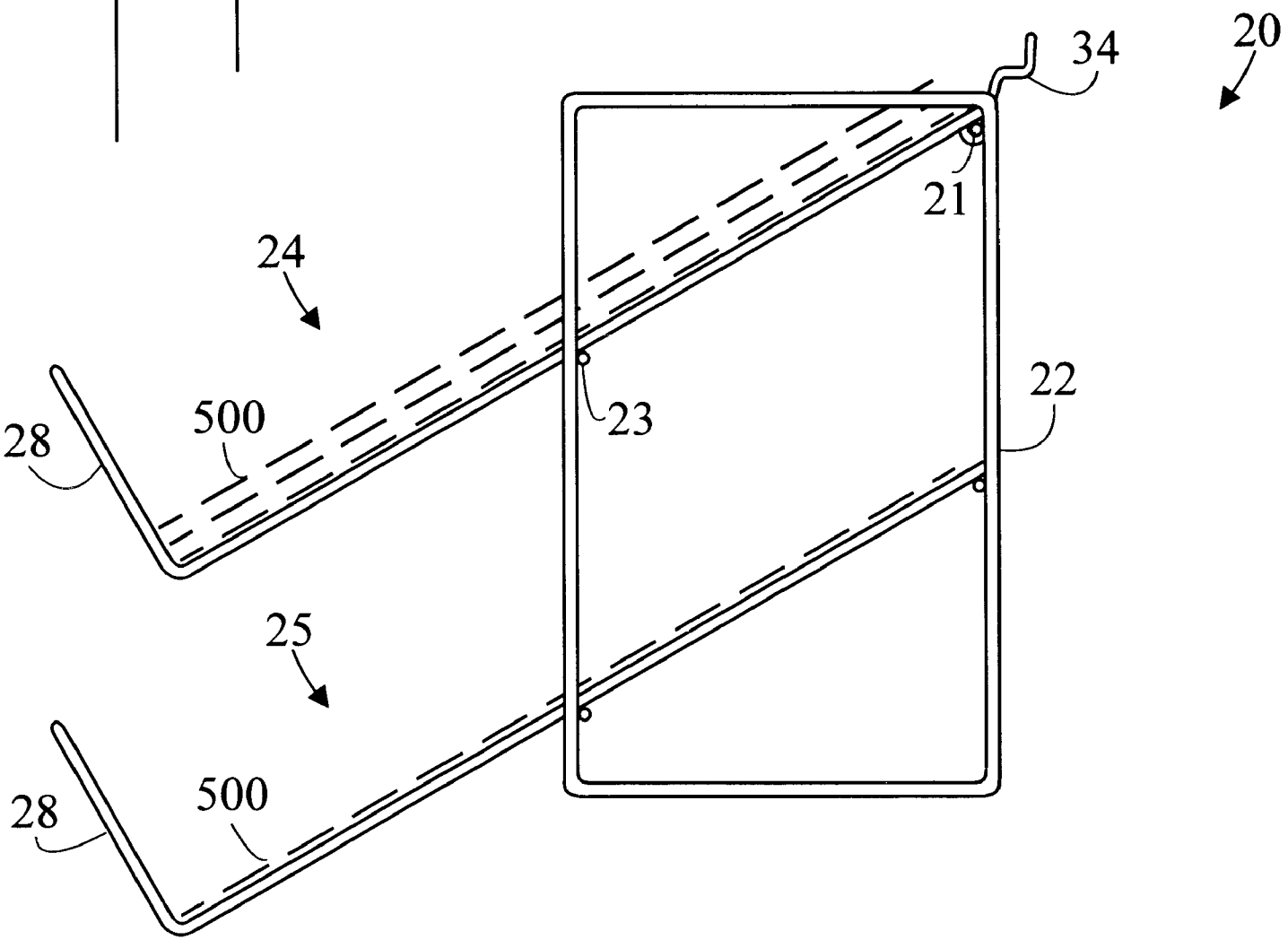
FIG. 5 is a side elevation view of the display rack.

Referring to FIG. 4, movable dividers 26 are laterally movable in directions 30 and 32, thereby permitting the relative size of two adjacent stations 24 or 25 to be altered.

Figures 6, 7:
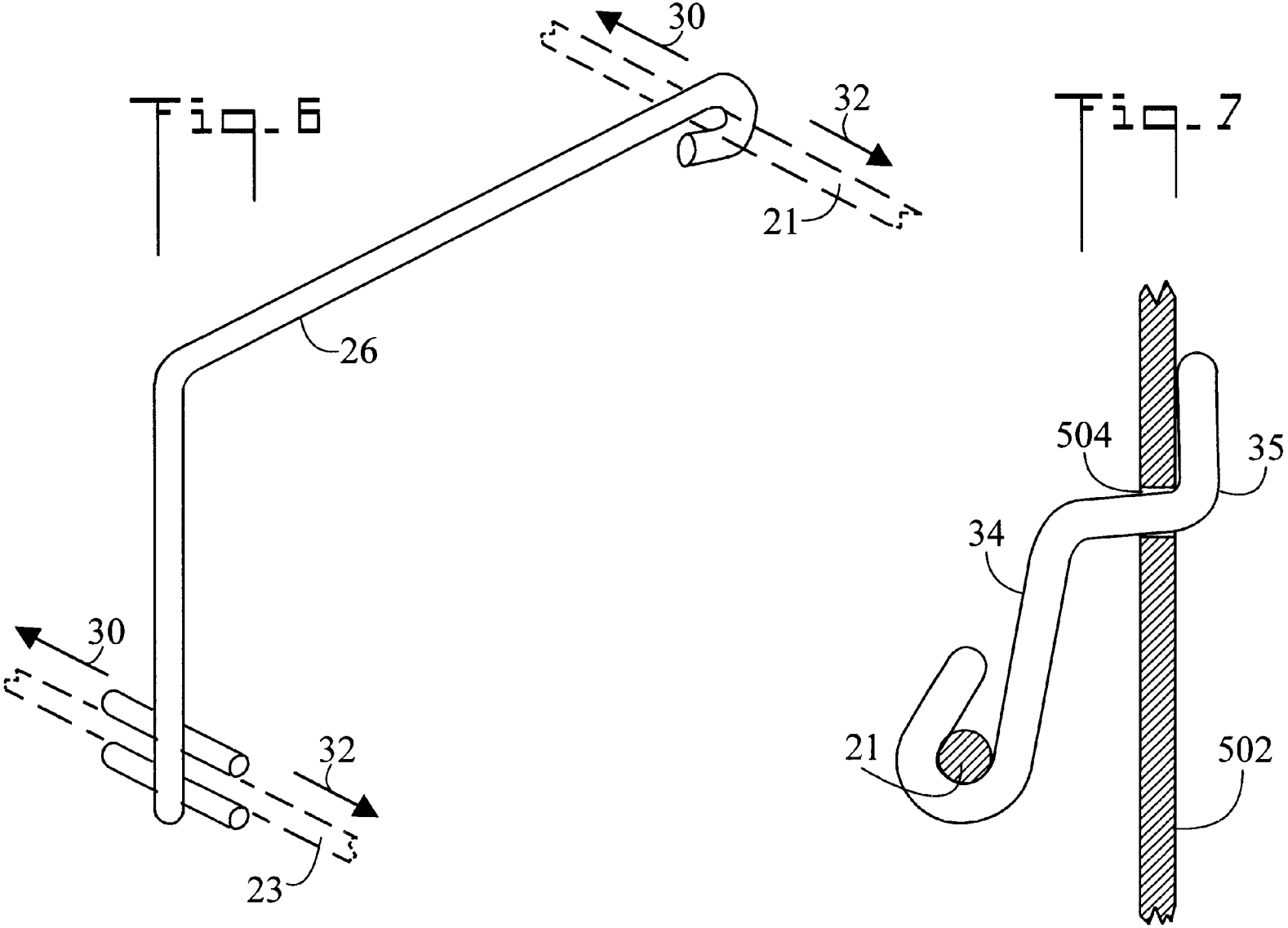
FIG. 6 is an enlarged perspective view of a movable divider.
FIG. 7 is an enlarged side elevation view of a pegboard connector for connecting the display rack to a pegboard.

FIG. 6 is an enlarged perspective view of movable divider 26. Movable divider 26 is selectively slidable in directions 30 and 32 along lateral members 21 and 23 of frame 22 which are parallel to each other (also refer to FIGS. 1 and 2). The divider is movable because of two features: a loop at the top which bends loosely around the top lateral member 21 of the rack and parallel bars at the bottom which are close enough together to fit securely on the bottom lateral member 23. The angle of the bend in the middle of the divider 26 can also be adjusted to press the bottom parallel bars against the bottom lateral member 23. The divider is moved by pulling the bottom parallel bars off of the bottom lateral member 23 and sliding the top to the left or right and then pressing the bottom parallel bars onto the bottom lateral member at the desired new location.

FIG. 7 is an enlarged side elevation view of a pegboard connector 34 for connecting display rack 20 to a pegboard 502. Pegboard connector 34 is loosely captively connected to lateral member 21 of frame 22 by a loop at its end. End portion 35 of pegboard connector 34 is inserted into hole 504 in pegboard 502, and retains display rack 20 in position on pegboard 502. The position of the pegboard connector 34 on lateral member 21 can be easily adjusted by sliding it to the left or right similar to what is shown in FIG. 6.

Figure 8:
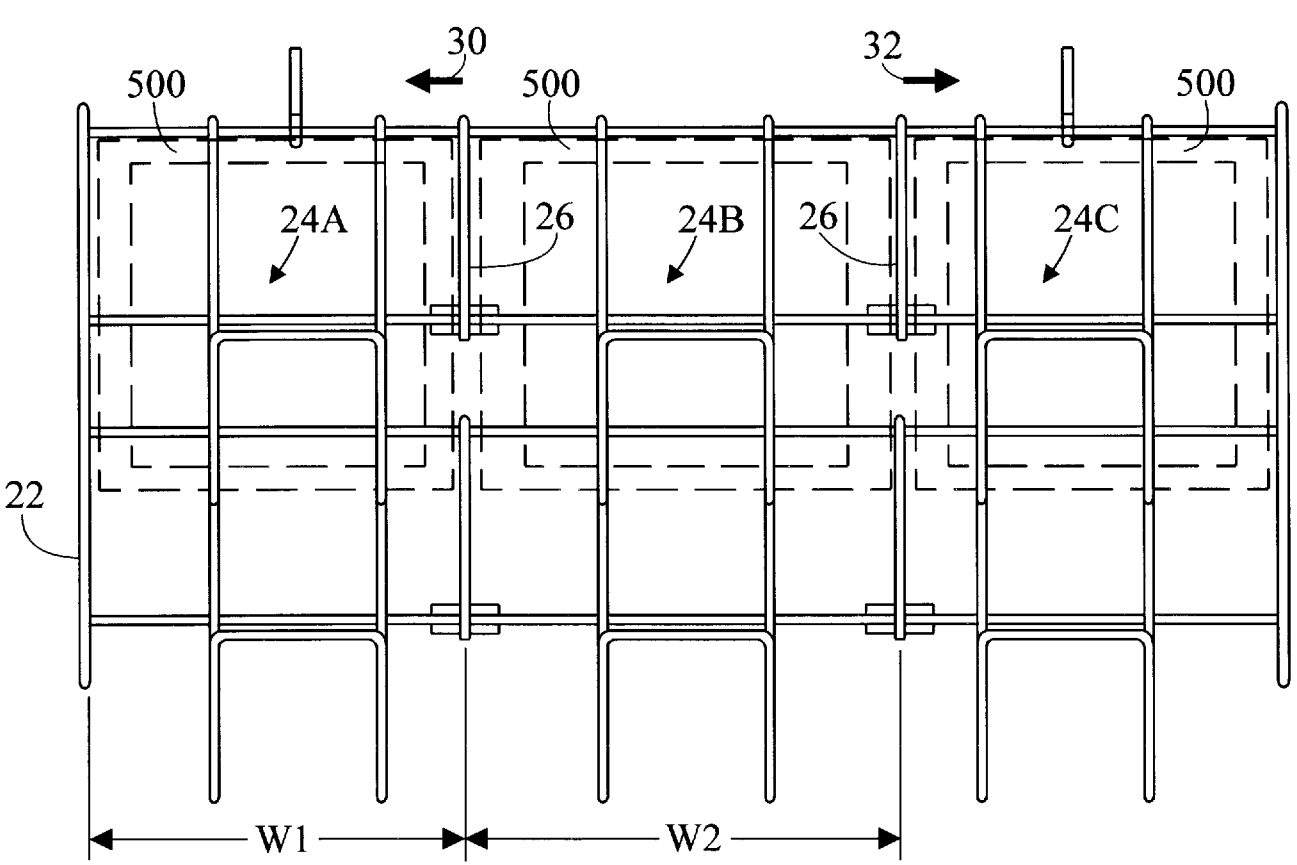
FIG. 8 is a front elevation view showing the movable dividers moved to a different position.

FIG. 8 is a front elevation view showing the movable dividers 26 moved to a different position. Frame 22 has first license plate frame receiving station 24A and second license plate frame receiving station 24B arranged in side-by-side relationship. First and second stations, 24A and 24B, are dimensioned to receive license plate frames 500. First and second stations, 24A and 24B, are separated by slidably movable divider 26. When movable divider 26 is selectively moved in direction 30 from a first position (refer to FIG. 4) to a second position as shown, the width W1 of first station 24A is dimensionally reduced, while the width W2 of second station 24B is correspondingly dimensionally increased. This feature of the present invention is important in that it allows adjustment of display rack 20 to accommodate license plate frames of different widths W. Additionally FIG. 8 shows the movable divider 26 disposed between second station 24B and third station 24C moved in direction 32, thereby further enlarging the width W2 of station 24B. This configuration results in narrow outer stations 24A and 24C and wide inner station 24B.

Figure 9:
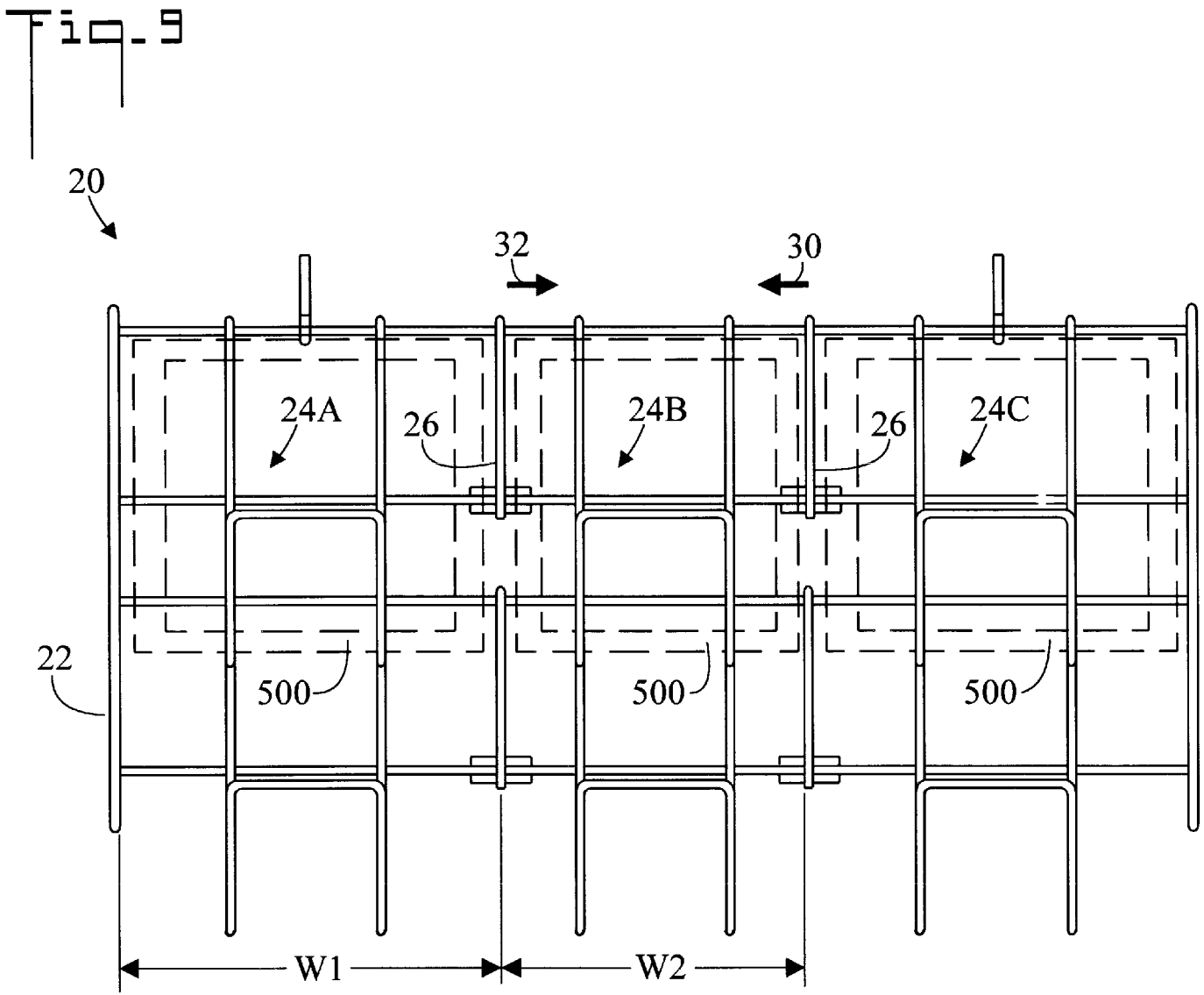
FIG. 9 is a front elevation view showing the movable dividers moved to another position; and, FIG. 10 is a front elevation view of the pegboard connectors moved to align with holes in the pegboard.

FIG. 9 is a front elevation view showing the movable dividers 26 moved to another different position. When movable divider 26 is selectively moved in direction 32 from a first position (refer to FIG. 4) to a second position as shown, the width W1 of first station 24A is dimensionally increased, while the width W2 of second station 24B is correspondingly dimensionally reduced. Additionally FIG. 9 shows the movable divider 26 disposed between second station 24B and third station 24C moved in direction 30, thereby further reducing the width W2 of station 24B. This configuration results in wide outer stations 24A and 24C and narrow inner station 24B.

Figure 10:
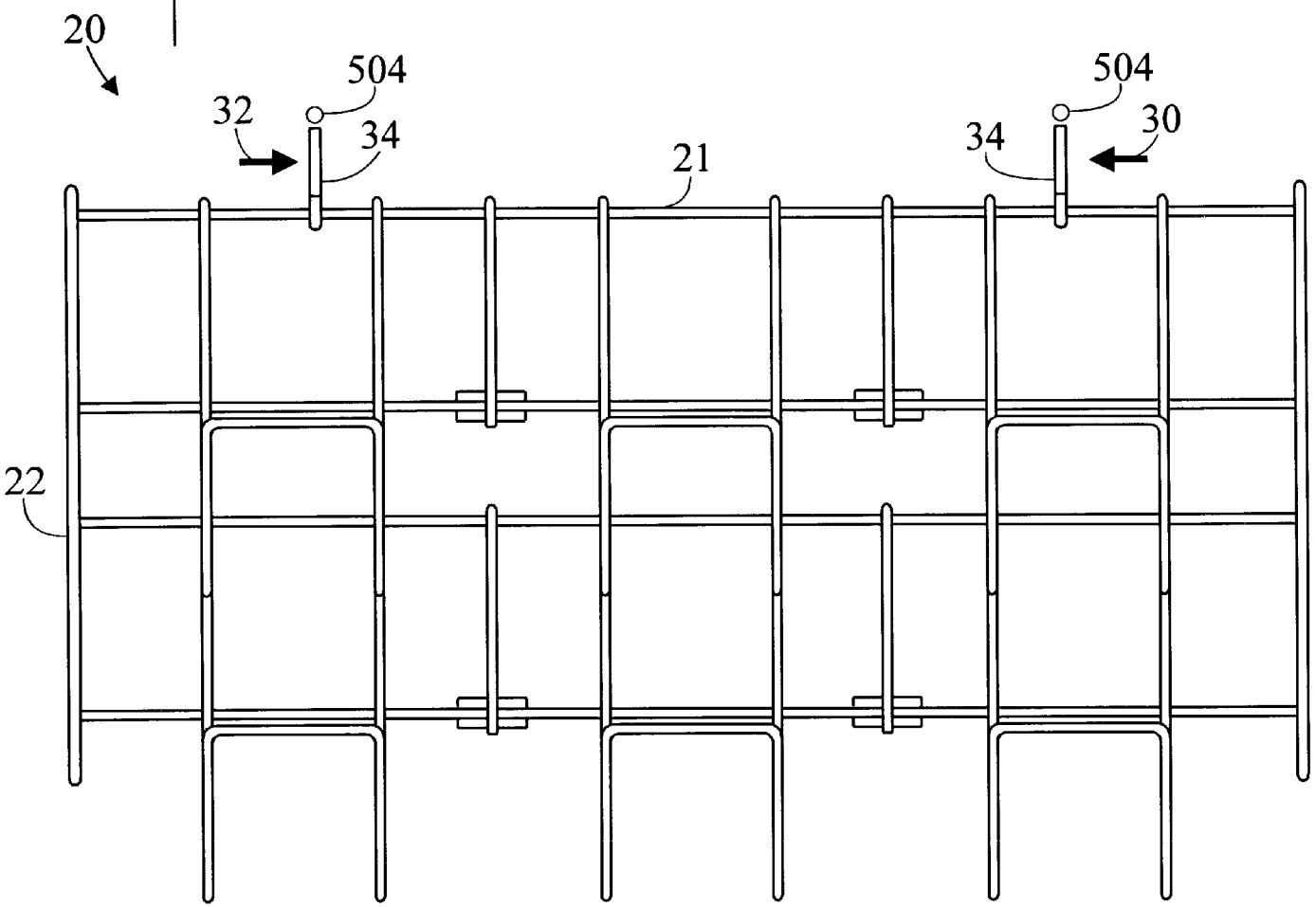

FIG. 10 is a front elevation view of pegboard connectors 34 moved to align with holes 504 in pegboard 502 (refer also to FIG. 7). Display rack 20 includes at least two pegboard connectors 34 for attaching frame 22 to pegboard 504. Pegboard connectors 34 are slidably connected to lateral member 21 of frame 22. Pegboard connectors 34 are selectively movable in directions 30 and 32 to align with holes 504 in pegboard 502. One or both of the pegboard connectors 34 may be moved. For example, the holes 504 may not be perfectly spaced in the pegboard. Then one or the other of the connectors can be put into a hole and the other moved slightly to match another hole. Or the installer may discover that one or the other of the selected holes is not available after trying to insert a connector such as would happen if a mounting strip for the pegboard were immediately behind the hole. The whole rack 20 can also be moved in relation to the pegboard. For example, the installer may install the rack on the pegboard and discover that one end hits a wall, sign, or other rack. He can then slide the rack to one side or the other without moving the connectors to clear the obstruction or place the rack in a more aesthetically pleasing location.

Another important feature of the present invention is that more license plate frames may be displayed in a given area compared to prior display methods which consist almost exclusively of two hooks on a pegboard for each frame. As can be seen from FIGS. 1, 2, and 4, the license plate frame 500 has a width and a height, the width being greater than the height. The license plate frame receiving stations 24 are oriented so that the height of the license plate frame 500 is aligned along the width of the display rack 20 which is a 90° rotation from prior displays. This means that in a store more license plate frames 500 can be displayed along a given display area width. Also, the rack 20 has two levels of license plate receiving stations: top license plate receiving stations 24 and bottom license plate receiving stations 25. The plates in the top stations are fully visible while the plates in the bottom level show enough to allow the potential buyer to decide if he wants to pull one out. Approximately 33% more plates can be shown using a rack 20 than using conventional methods.

In terms of use, a method for displaying license plate frames 500, comprises:

providing a display rack 20 for license plate frames 500, display rack 20 including a frame 22 having first 24A and second 24B license plate frame receiving stations, the first 24A and second 24B stations arranged in side-by-side relationship, first 24A and second 24B stations separated by a slidably movable divider 26, so that when movable divider 26 is selectively moved from a first position to a second position, the width W1 of first station 24A is dimensionally reduced, while the width W2 of second station 24A is correspondingly dimensionally increased;

providing a license plate frame 500 having a width W;

slidably moving movable divider 26 until width W1 of first station 24A is slightly larger than the width W of the license plate frame 500; and, placing the license plate frame 500 in first station 24A.

The method of using the present invention further includes:

the display rack 20 including at least two pegboard connectors 34 for attaching frame 22 to a pegboard 502, pegboard connectors 34 being slidably connected to frame 21, and the pegboard connectors 34 selectively movable to align with holes 504 in pegboard 502;

providing a pegboard 502 having a plurality of holes 504;

placing the display rack 20 adjacent to pegboard 502;

selectively moving the pegboard connectors 34 to align with holes 504 in the pegboard 502; and, inserting the pegboard connectors 34 into the holes 504 of the pegboard 502, thereby attaching the display rack 20 to the pegboard 502.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for displaying license plate frames, comprising:

providing a display rack for license plate frames, said display rack including a frame having first and second license plate frame receiving stations, said first and second stations arranged in side-by-side relationship, said first and second stations separated by a slidably movable divider, so that when said movable divider is selectively moved from a first position to a second position, said first station is dimensionally reduced, while said second station is correspondingly dimensionally increased;

providing a license plate frame having a width W;

slidably moving said movable divider until a width W1 of said first station is slightly larger than width W of the license plate frame; and, placing the license plate frame in said first station.

2. The method according to claim 1, further including:

said display rack including at least two pegboard connectors for attaching said frame to a pegboard, said pegboard connectors slidably connected to said frame, and said pegboard connectors selectively movable so as to align with holes in the pegboard;

providing a pegboard having a plurality of holes;

placing said display rack adjacent to the pegboard;

selectively moving said pegboard connectors to align with holes in the pegboard; and, inserting said pegboard connectors into the holes of the pegboard, thereby attaching said display to the pegboard.

* * * * *